US007814727B2

(12) United States Patent
LaCasse

(10) Patent No.: US 7,814,727 B2
(45) Date of Patent: Oct. 19, 2010

(54) WALL STRUCTURE ASSEMBLY

(75) Inventor: Steven Bi LaCasse, Port Saint Lucie, FL (US)

(73) Assignee: Jake & Elwood Holding Company, Ormond Beach, FL (US)

( * ) Notice: Subject to any disclaimer, the term of this patent is extended or adjusted under 35 U.S.C. 154(b) by 0 days.

(21) Appl. No.: 12/313,369

(22) Filed: Nov. 17, 2008

(65) Prior Publication Data

US 2010/0122509 A1 May 20, 2010

(51) Int. Cl.
*E04B 1/61* (2006.01)

(52) U.S. Cl. ..... 52/764; 52/63; 52/222; 52/656.7; 52/780; 52/846

(58) Field of Classification Search ..... 52/63, 52/222, 656.7, 653.1, DIG. 17, 781.3, 780, 52/772, 775, 764, 781, 846, 836
See application file for complete search history.

(56) References Cited

U.S. PATENT DOCUMENTS

| | | | | | |
|---|---|---|---|---|---|
| 3,380,210 | A * | 4/1968 | Neal et al. | 52/235 |
| 4,237,665 | A * | 12/1980 | Molyneux | 52/213 |
| 4,689,929 | A * | 9/1987 | Wright | 52/239 |
| 4,850,167 | A * | 7/1989 | Beard et al. | 52/200 |
| 4,920,714 | A * | 5/1990 | Sease | 52/222 |
| 4,986,332 | A * | 1/1991 | Lanuza | 160/327 |
| 5,076,033 | A * | 12/1991 | Patsy, Jr. | 52/222 |
| 5,242,004 | A * | 9/1993 | Stilling | 160/57 |
| 5,596,843 | A * | 1/1997 | Watson | 52/71 |
| 5,806,268 | A * | 9/1998 | Koller | 52/653.1 |
| 6,035,596 | A * | 3/2000 | Brunnhofer | 52/404.1 |
| 6,112,493 | A * | 9/2000 | Rickman | 52/640 |
| 6,192,643 | B1 * | 2/2001 | Zadok | 52/648.1 |
| 6,338,226 | B1 * | 1/2002 | Gauthier et al. | 52/63 |
| 6,345,638 | B1 * | 2/2002 | Warner | 135/123 |
| 6,389,770 | B1 * | 5/2002 | Santavicca | 52/474 |
| 6,574,936 | B1 * | 6/2003 | Anderson, Sr. | 52/506.06 |
| 6,668,495 | B1 * | 12/2003 | Prince | 52/63 |
| 7,063,096 | B2 * | 6/2006 | Stoeckler | 135/114 |
| 7,448,154 | B1 * | 11/2008 | Kludt | 40/446 |
| 2007/0023076 | A1 * | 2/2007 | Eide et al. | 135/157 |

* cited by examiner

*Primary Examiner*—David Dunn
*Assistant Examiner*—Joshua Ihezie
(74) *Attorney, Agent, or Firm*—Niro, Haller & Niro

(57) ABSTRACT

A wall panel structure which is easily assembled and disassembled and is constructed from a plurality of frame assemblies, each frame assembly comprising a first frame component having a first wall and an adjacent second wall, the first wall having an externally accessible abutment surface; and a second frame component having an angled cross section defined by first and second arms, the first arm having an inwardly extending flange configured to engage said abutment surface of the first frame component, and the second arm configured to engage the second wall of the first frame component.

5 Claims, 4 Drawing Sheets

WALL STRUCTURE ASSEMBLY

BACKGROUND OF INVENTION

The present invention relates generally to wall and wall panel structures and to enclosures made from such panel structures. The invention finds particular application and advantage in the construction of screen enclosures.

It is well known that easily assembled and disassembled wall panel structures have significant utility. It is also well known that such panel structures can be useful in the construction of various forms of enclosures, such as screened porches and patios, lanais and gazebos. Other enclosures with panels fabricated from lightweight materials other than screens, such as tool and garden sheds and hunting and fishing blinds, also benefit from construction designs that permit easy assembly and disassembly. The technical literature shows a wide variety of designs useful in such applications, yet there still exists a need for a light weight, inexpensive wall panel design which may be easily assembled and disassembled with few if any tools. Such a design facilitates cleaning, maintenance and repair of the enclosures and makes them much more suitable for use in climates where winter snowfalls require annual removal of the enclosure roof panels.

SUMMARY OF INVENTION

The present invention is directed to a wall panel structure which is easily assembled and disassembled and is constructed from a plurality of frame assemblies, each frame assembly comprising a first frame component having a first wall and an adjacent second wall, the first wall having an externally accessible abutment surface; and a second frame component having an angled cross section defined by first and second arms, the first arm having an inwardly extending flange configured to engage said abutment surface of the first frame component, and the second arm configured to engage the second wall of the first frame component.

In one disclosed embodiment the wall panel structure includes at least one tubular wall frame member and first and second panel frame members. The tubular wall frame member is formed to have a generally rectangular cross section defined by four sides, one side having a pair of opposing abutment surfaces. The first and second panel frame members each have two arms defining a generally L shaped cross section. The first arm of the first panel frame member terminates at a distal end having a retaining lip adapted to engage one of the abutment surfaces on the frame member, and the second arm of the first panel frame member is positioned and configured to engage a second side of the wall frame member which is adjacent to the side with the abutment surfaces. The first arm of the second panel frame member also terminates at a distal end having a retaining lip adapted to engage the other abutment surface on the wall frame member, and the second arm of the second panel frame member is positioned and configured to engage a third side of the wall frame member opposite to said second side. The first and second panel frame members also have spline channels configured to receive a spline and a border of a panel sheet member. One or more retainers engage the wall frame member and the panel frame members to maintain said members in assembled relation.

BRIEF DESCRIPTION OF DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENTS

Figure 1:
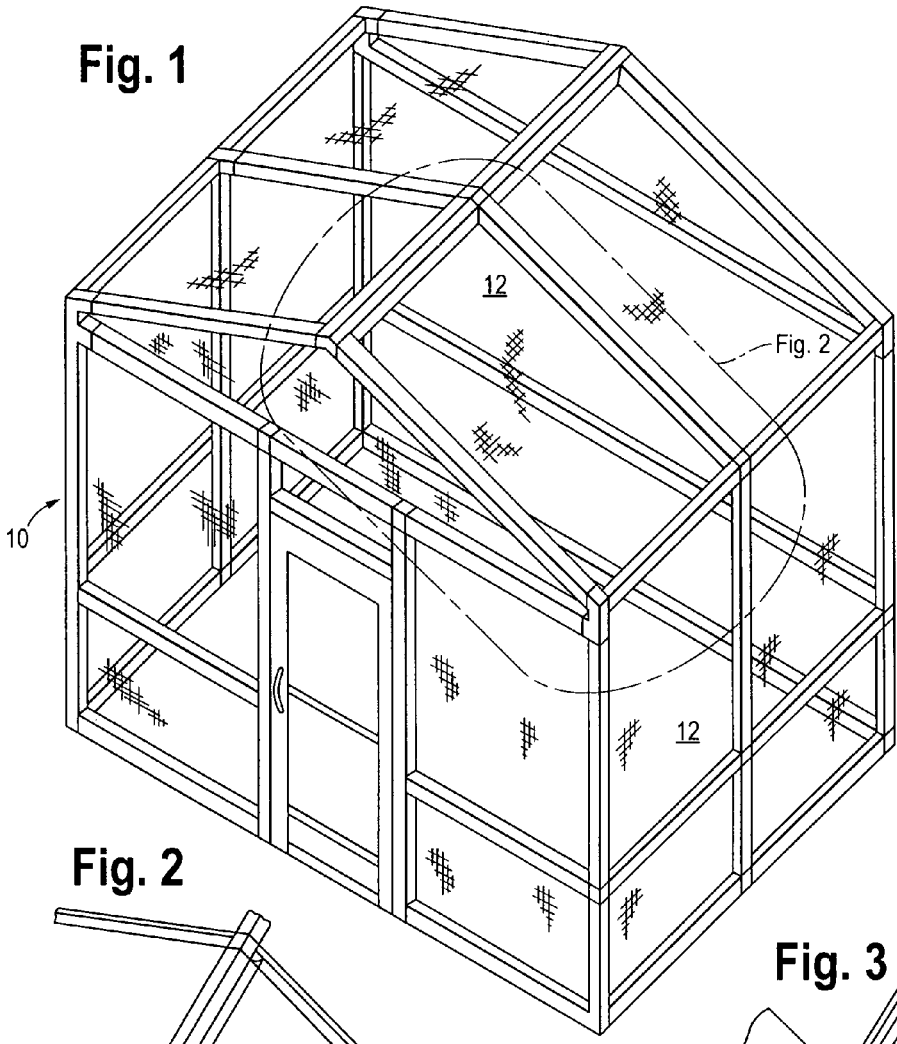
FIG. 1 is a perspective view showing a screened enclosure constructed of the wall structures of the present invention.
Figure 2:
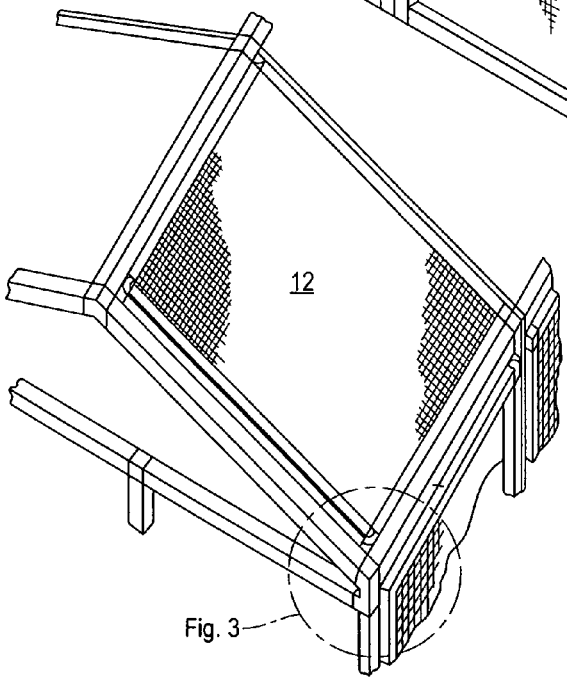
FIG. 2 is an enlarged partial perspective view taken from FIG. 1 and showing further details of the enclosure.
Figure 3:
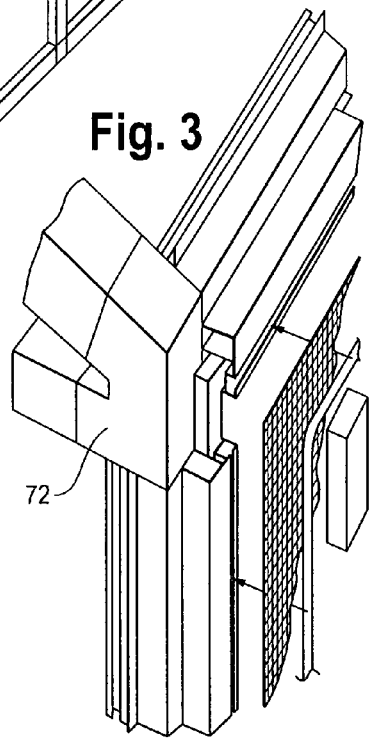
FIG. 3 is a further enlarged perspective view taken from FIG. 2.

As illustrated in FIGS. 1-3, the present invention finds suitable use in building structures such as a screened enclosure 10. Other building structures can advantageously be constructed in accordance with the present invention, including gazebos, lanais, hunting and fishing blinds, tool and garden sheds and fences.

The screened enclosure 10 is constructed with a plurality of panels 12 which make use of a unique wall panel structure allowing the enclosure to be easily assembled and disassembled. The wall panel structure includes a skeleton of wall frame components 14 which support the many screened panels 12. In some cases, for example on the side walls of the enclosure, the screen panels may be assembled directly to the wall frame components, using a conventional spline recess and spline. In other cases, for example on the roof of the enclosure, the screen panels may be assembled to the wall frame components 14 using the novel frame assembly of the present invention.

Figure 5:
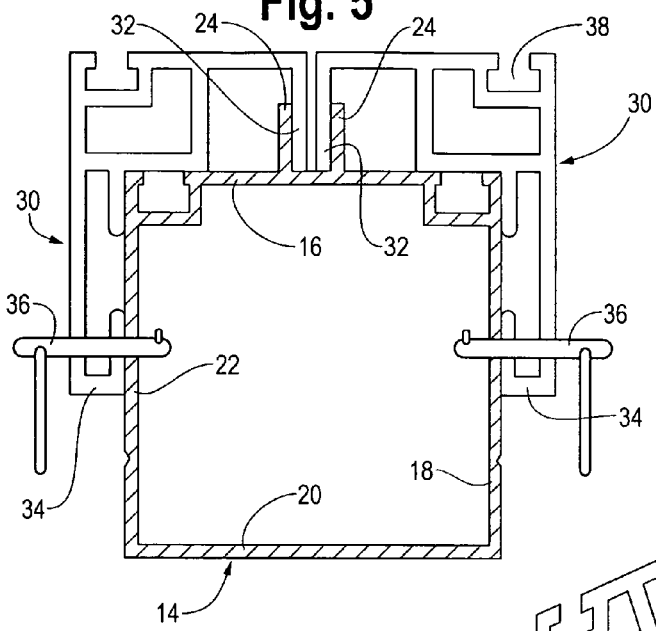
FIG. 5 is a cross sectional view taken along line 5-5 of FIG. 4.
Figure 8:
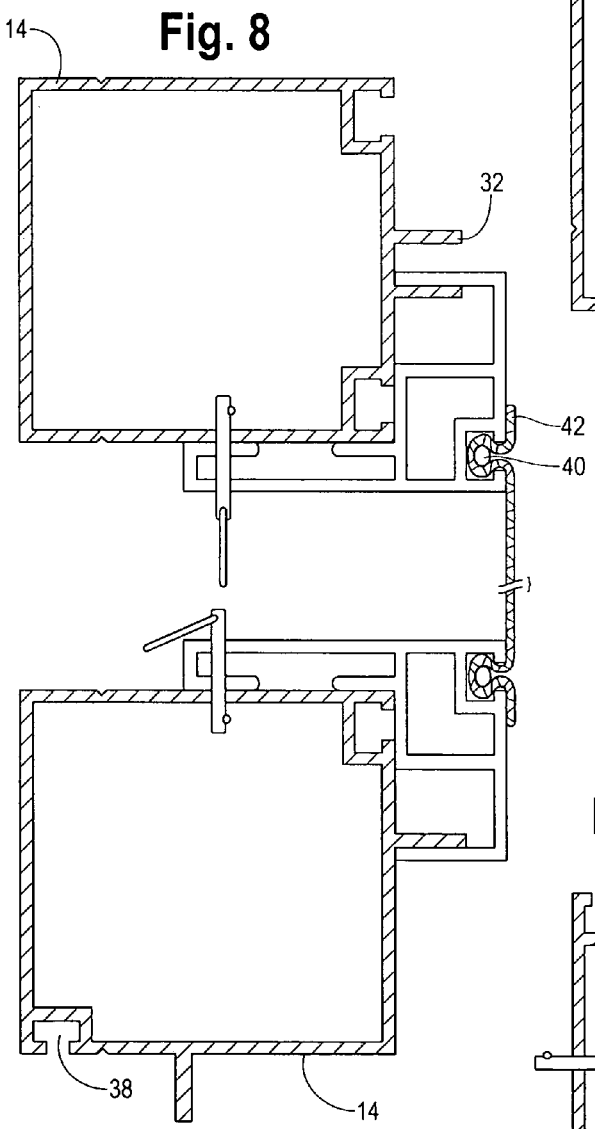
FIG. 8 is a cross sectional view taken along line 8-8 of FIG. 4 and showing one panel assembly constructed in accordance with the teachings of the present invention.

FIGS. 5 and 8, illustrate the wall structure assembly in greater detail. These figures are cross sectional views and illustrate the details of construction which provide the present invention with its unique advantages. The wall frame component 14 has a tubular and generally rectangular cross section comprising four side walls 16, 18, 20 and 22. Wall 16 includes at least one, but as many as two, externally accessible abutment surfaces. In the illustrated embodiment the abutment surfaces are provided by flanges 24 extending from wall 16. A complementary panel frame component 30 is assembled to the wall frame component 14. The panel frame component has a generally L shaped or angled cross section, with one arm of the L engaging wall 16 and terminating in an inwardly extending flange or lip 32 which engages flange 24. The other or second arm of the L rests against the wall 18 of the wall frame component. The second arm also preferably terminates in a double wall construction, shown in this embodiment as a J shaped free end 34. A retainer, in the form of a lock pin 36 extends through the wall frame and panel frame components to maintain the two components in assembled relation. The external surface of the panel frame component's first arm is provided with a spline recess or groove 38 which is sized and configured to receive a spline 40 and the border 42 of the screen 12 panel. Of course, a single screen panel 12 will include the screen material joined to four panel frame components 30, thereby forming a complete panel. Each of the panel frame components 30 will, in turn, assemble to a complementary wall frame component 14, and in this way the wall or roof of the enclosure may be assembled.

The wall frame components 14 may also include spline grooves 38 so that the screen material may be assembled directly to the wall frame in a more permanent fashion, if that is desired, without the use of the panel frame components 30.

Figure 6:
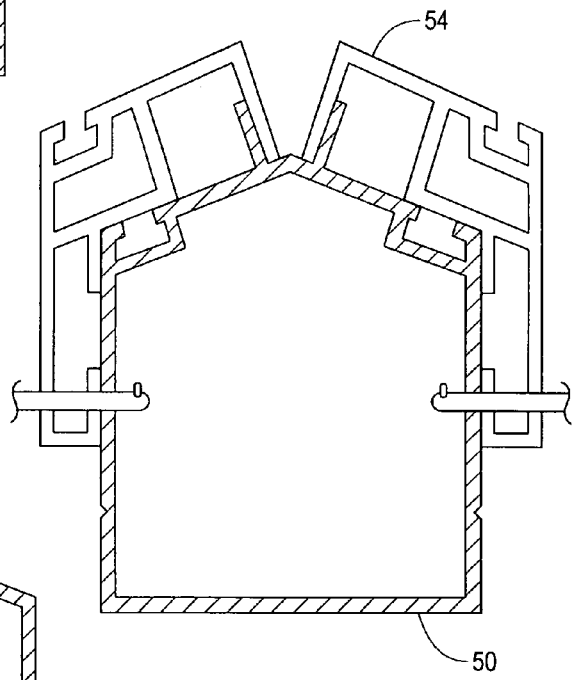
FIG. 6 is a cross sectional view taken along line 6-6 of FIG. 4.
Figure 7:
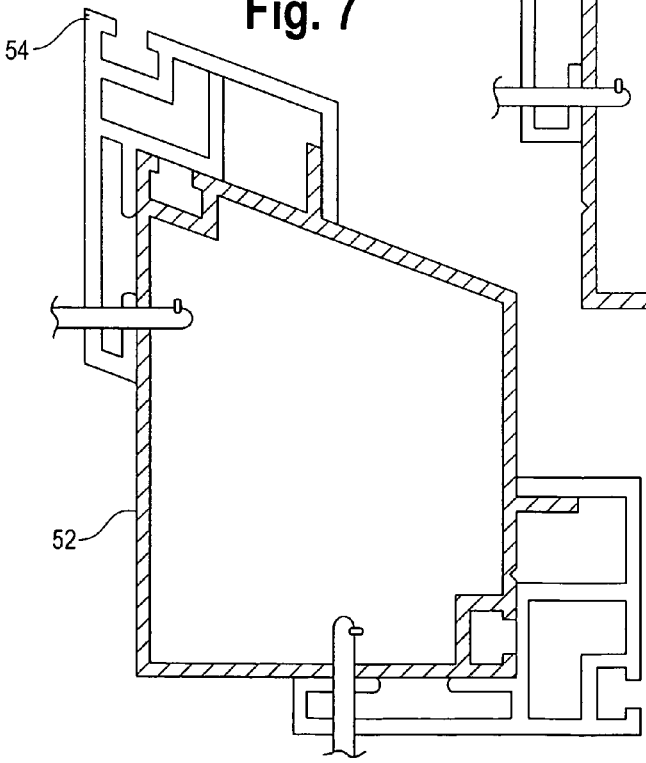
FIG. 7 is a cross sectional view taken along line 7-7 of FIG. 4.

FIGS. 6 and 7 show wall frame components 50 and 52 similar to the wall frame component 14 shown in FIG. 5, but for use in the ridge and eave of the enclosure's roof. Of course, due to the difference in the cross sectional configurations, the angles of the complementary panel frame components 54 are different from the right angle configuration of the L shaped panel frame component 30.

Figure 9:
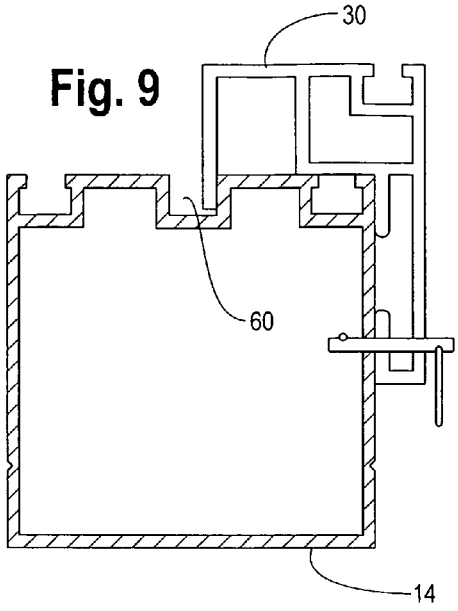
FIGS. 9 and 10 are cross sectional views similar to that of FIG. 5 but showing alternative embodiments of the present invention.
Figure 10:
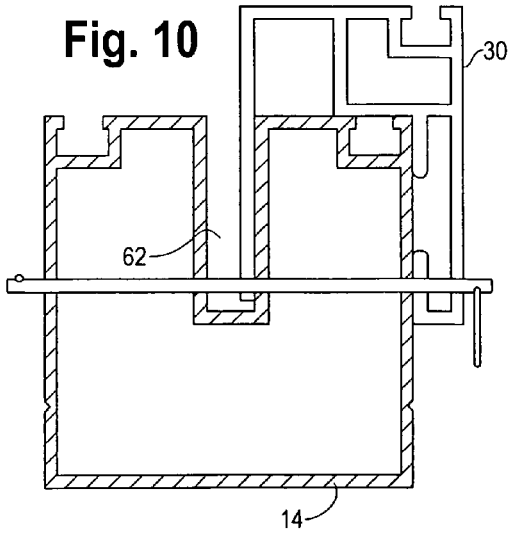

FIGS. 9 and 10 show alternate embodiments of the wall frame component 14 with the externally accessible abutment surfaces being provided by recesses 60 and 62, respectively.

Figure 4:
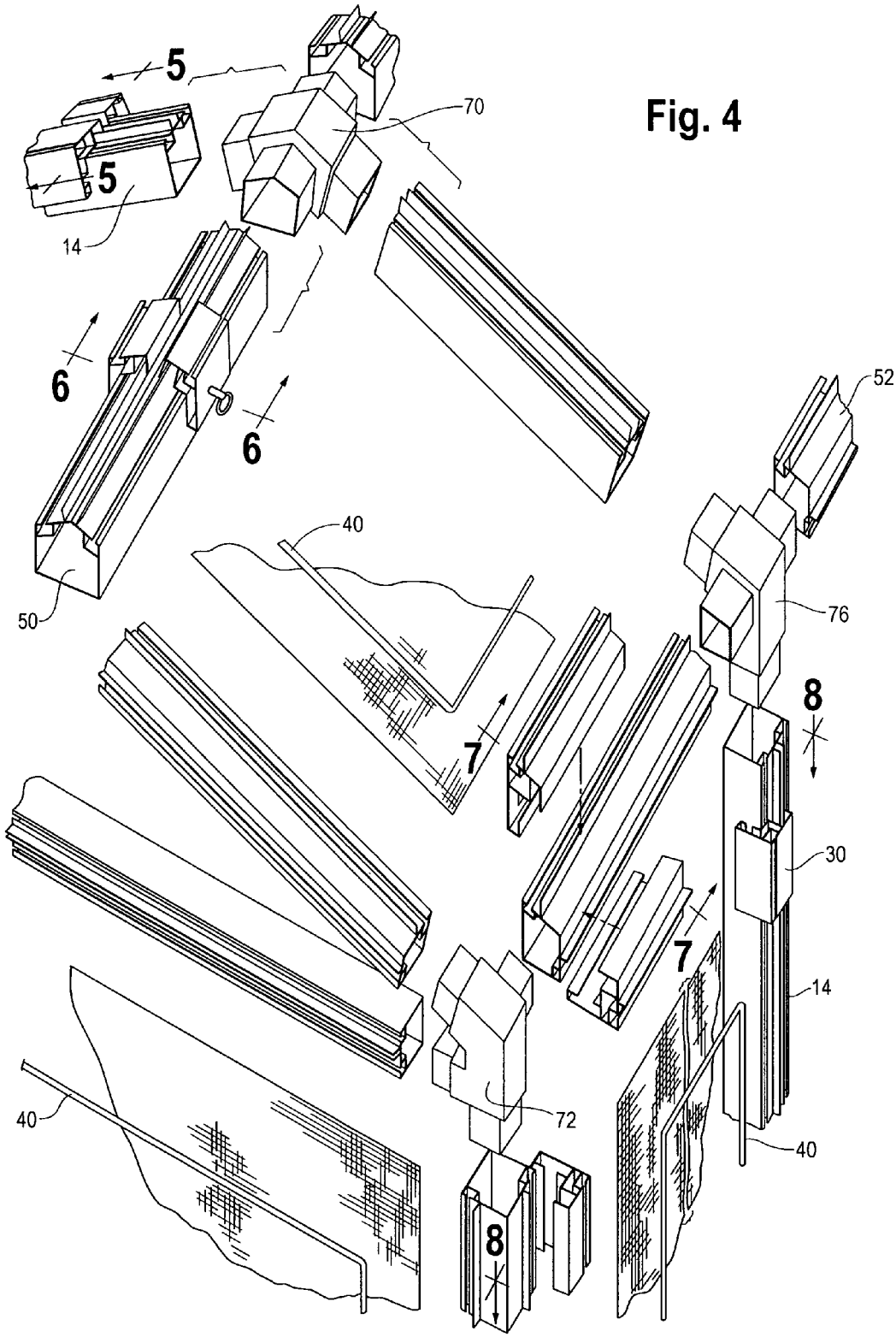
FIG. 4 is an exploded perspective view illustrating the manner in which various components of the wall structure of the present invention are assembled.

As shown in FIGS. 2-4, the various wall frame components may be joined by fittings 70, 72 and 76 which fit into the ends of the components.

The wall frame component 14 and the panel frame component 30 may be advantageously constructed from extruded plastic or aluminum, both of which afford a light weight and durable enclosure. The fittings may be constructed from molded plastic or elastomer.

It will be appreciated by those skilled in the art that various changes and modifications can be made to the illustrated embodiments without departing from the spirit of the present invention. For example, the sheet material forming the panels need not be screen, but may comprise other sheeting such a plastic film. All such modifications and changes are intended to be covered by the appended claims.

I claim:

1. A wall structure assembly for construction of an enclosure comprising:

an enclosure wall having a plurality of wall frame components, each wall frame component having a first wall and a second wall, the first wall having an externally extending flange defining a laterally facing abutment surface; and at least one panel releasably mounted to the enclosure wall and having a plurality of panel frame components supporting a panel sheet, each panel frame component having an angled cross section defining first and second arms, the first arm having a free end with a retainer flange which engages the laterally facing abutment surface of said externally extending flange, and the second arm extending below the level of the first wall and engaging a laterally facing surface of the second wall.

2. The wall structure assembly of claim 1 further comprising a retention member adapted to engage both the second arm of the panel frame component and the second wall of the wall frame component.

3. The wall structure assembly of claim 2 wherein the second arm of the panel frame component has a free end with a J shaped cross section.

4. The wall structure assembly of claim 1 wherein the first arm of the panel frame component includes a recess adapted to receive and retain a panel sheet member.

5. The wall structure assembly of claim 4 wherein said panel sheet member comprises a screen or plastic film.

* * * * *